US005184580A

United States Patent [19]

Ascari

[11] Patent Number: 5,184,580

[45] Date of Patent: Feb. 9, 1993

[54] TIMING SYSTEM FOR AN INTERNAL COMBUSTION ENGINE

[75] Inventor: Ennio Ascari, Formigine, Italy

[73] Assignee: Ferrari S.p.A., Modena, Italy

[21] Appl. No.: 784,180

[22] Filed: Oct. 30, 1991

[30] Foreign Application Priority Data

Oct. 30, 1990 [IT] Italy ..... 67840 A/90

[51] Int. Cl.[5] ..... F01L 1/26

[52] U.S. Cl. ..... 123/90.27; 123/90.22; 123/308

[58] Field of Search ..... 123/90.22, 90.23, 90.27, 123/90.48, 308

[56] References Cited

U.S. PATENT DOCUMENTS

| | | | |
|---|---|---|---|
| 3,712,277 | 1/1973 | Piatti | 123/90.27 |
| 4,658,780 | 4/1987 | Hosoi | 123/90.22 |
| 4,805,567 | 2/1989 | Heimburg | 123/90.22 |
| 4,915,065 | 4/1990 | Yamada | 123/90.27 |
| 5,094,197 | 3/1992 | Rosa | 123/90.27 |
| 5,095,858 | 3/1992 | Ascari | 123/90.27 |

FOREIGN PATENT DOCUMENTS

| | | | |
|---|---|---|---|
| 3831333 | 3/1990 | Fed. Rep. of Germany | 123/90.27 |
| 11108 | 1/1991 | Japan | 123/90.27 |

*Primary Examiner*—E. Rollins Cross
*Assistant Examiner*—Weilun Lo
*Attorney, Agent, or Firm*—Shlesinger Arkwright & Garvey

[57] ABSTRACT

A timing system, in particular for high performance internal combustion engines, having five or more valves per cylinder, is described. Three identical valves serving a given cylinder of an engine are controlled by a single camshaft by means of a pair of corresponding cams which act together with a pair of tappets which are mounted slidably in corresponding guides in the cylinder head. The tappets act together at the edges with corresponding valve stems of the three valves which are slidably mounted within second guides within the cylinder head, against the force of corresponding elastic means in a radially eccentric position with respect to the axis of the tappets in such a way that the valve stem of the intermediate valve acts simultaneously with both tappets, while the valve stems of the two lateral valves each act together with a corresponding different tappet in positions of mirror-image symmetry with respect to the center plane of the cylinder passing through the axis of the intermediate valve.

6 Claims, 4 Drawing Sheets

TIMING SYSTEM FOR AN INTERNAL COMBUSTION ENGINE

BACKGROUND OF THE INVENTION

This invention relates to a timing system to control the inflow or outflow of a fluid from one or more cylinders of an engine and/or an operating machine by means of corresponding valves controlled by means of a camshaft. In particular this invention relates to an overhead camshaft timing system for an internal combustion engine of the type having several valves per cylinder, for example of the five valve type.

It is known that in order to improve the volumetric efficiency of internal combustion engines, in particular the high performance engines used to equip sports cars or GT cars, there is a common design tendency to provide timing systems which instead of the conventional two valves per cylinder (one inlet and one exhaust) provide systems with several valves per cylinder, for example four (two inlet and two exhaust) or five (three inlet and two exhaust) or six (three inlet and three exhaust). In particular the latter two types of arrangement give rise to considerable structural complications in controlling the valves and/or give rise to serious problems with the arrangement of the valves in order to avoid interference, especially between the tappets of the three inlet valves. In order to overcome these problems it is known from U.S. Pat. No. 4,615,309 to use a divaricated arrangement of the inlet valves, placing the intermediate valve of the three obliquely with respect to the two lateral valves in such a way that the three valves can be controlled by a single camshaft, and using tappets having cups of less than normal diameter and, in the case in point, less than the diameter of the cups of the exhaust valves.

Such an arrangement is not however without disadvantages: in particular the use of cups of smaller diameter, especially with valves which are inclined with respect to the camshaft, and therefore subject to possible lateral thrust on the tappets, involves the risk of increasing the contact pressure between the cups and the guides when the latter are mounted in the cylinder head with a consequent risk of breakage of the lubricating oil film and/or in any event greater wear under load of the moving parts.

SUMMARY OF THE INVENTION

The object of the invention is to provide a timing system which is particularly suitable for use on high performance internal combustion engines without the abovementioned disadvantages. In particular it is an object of the invention to provide a timing system whereby tappets having cups of large diameter may be used, thus making it possible to use valves with an axis parallel to the cylinder axes, in such a way as to limit the lateral thrust on the guides, and to permit the engines combustion chambers to be constructed in a thermodynamically advantageous form.

The above object is achieved through the invention which relates to a timing system, in particular for an internal combustion engine, in which the camshaft controls identical valves, against the force of corresponding elastic means, which serve a cylinder by means of corresponding cams which act together with the interposition of corresponding tappets slidably mounted in first seats in a cylinder head with corresponding stems of the said valves slidably guided within second seats in the cylinder head, characterised in that the said stems are placed parallel to each other and the sliding axes of the said tappets and are arranged radially eccentrically with respect to the latter by an amount such that the stems act together with the tappets in a peripheral position close to the corresponding lateral walls of the tappets, at least one of the said tappets simultaneously acting in concert with both the stems of a pair of adjacent valves.

BRIEF DESCRIPTION OF THE DRAWINGS

For a better understanding of the invention a non-restrictive description of an embodiment thereof is now provided with references to the appended drawing, in which.

DETAILED DESCRIPTION OF THE INVENTION

Figure 1:
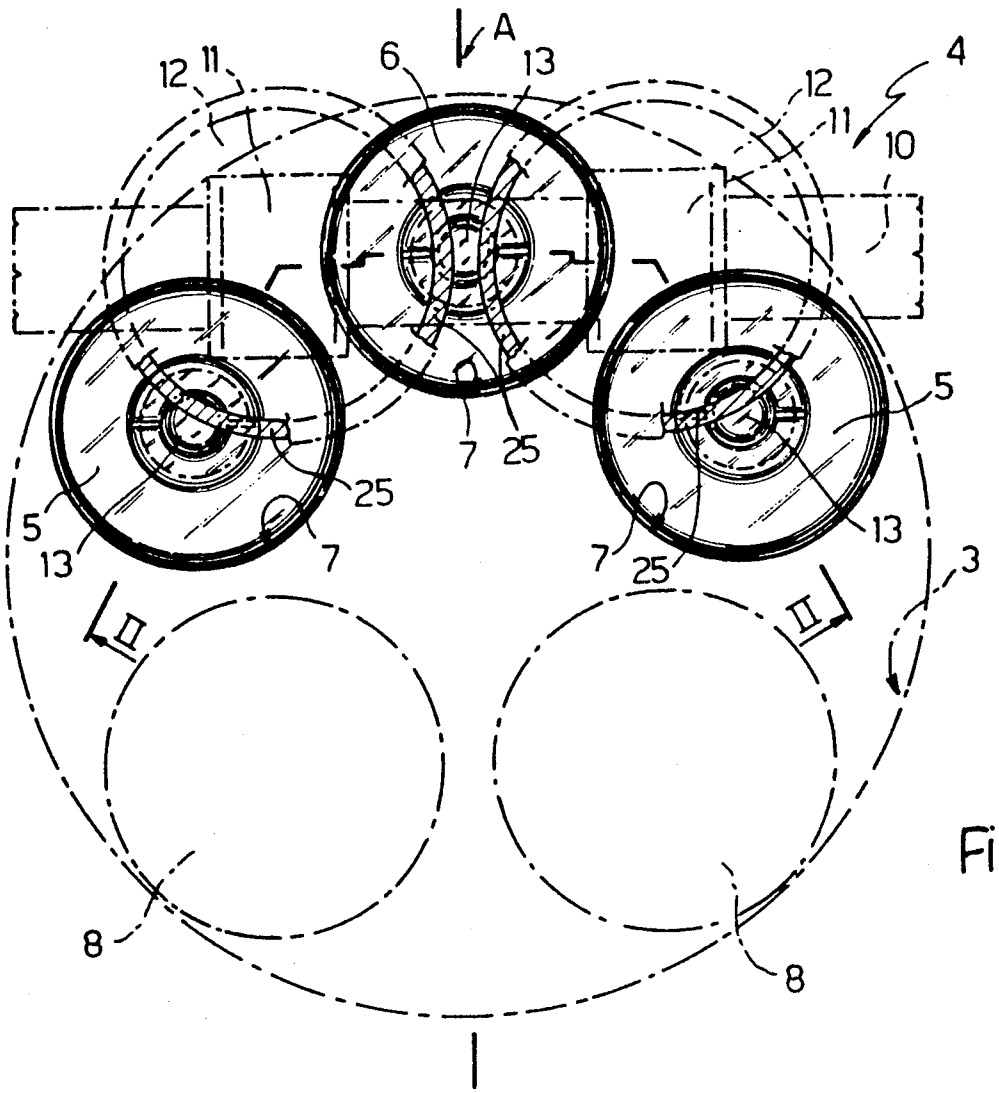
FIG. 1 illustrates the timing system according to the invention diagrammatically and in plan.
Figure 2:
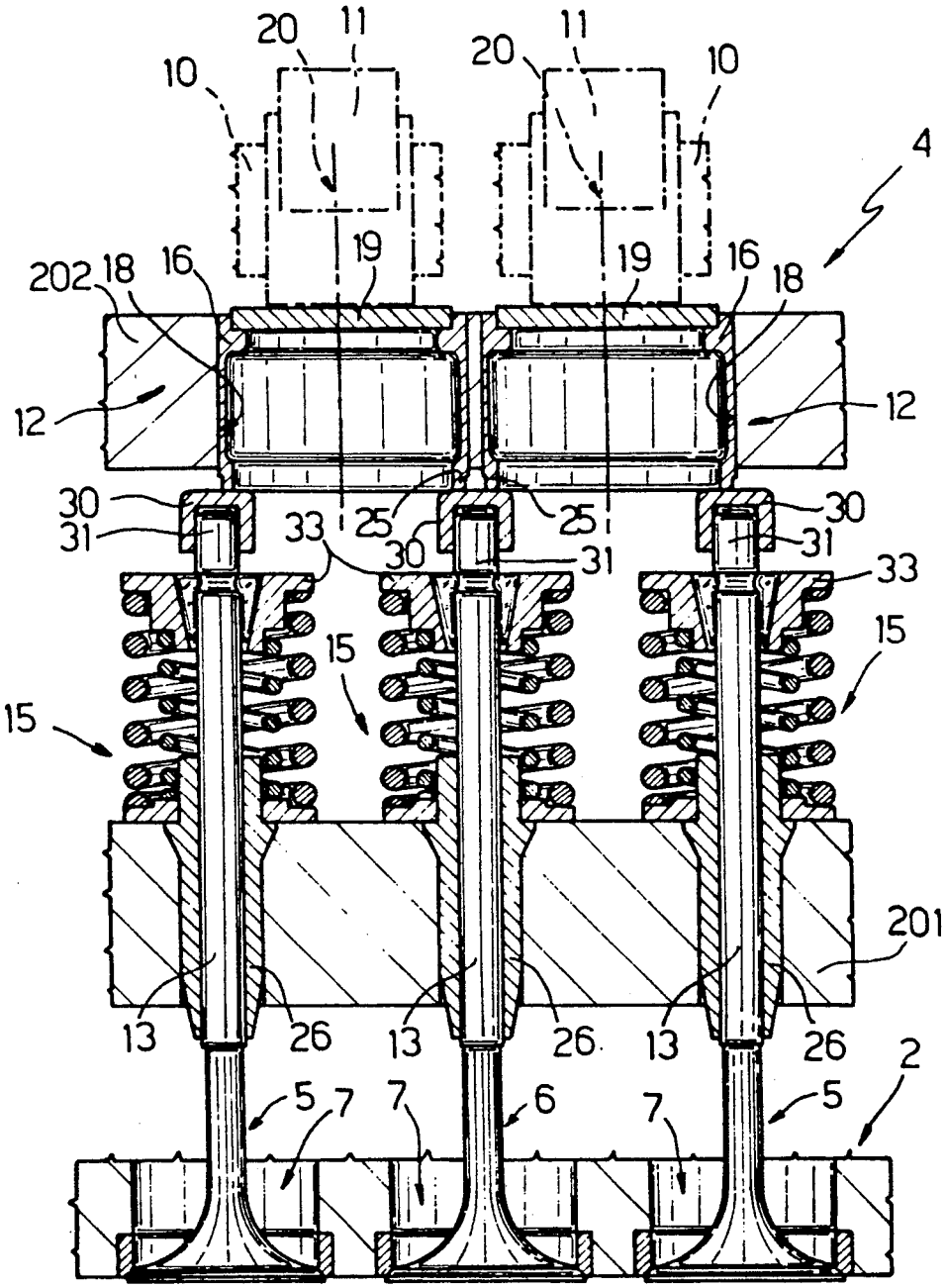
FIG. 2 is a view in elevation of the system in FIG. 1 in cross-section along a plane II—II.
Figure 3:
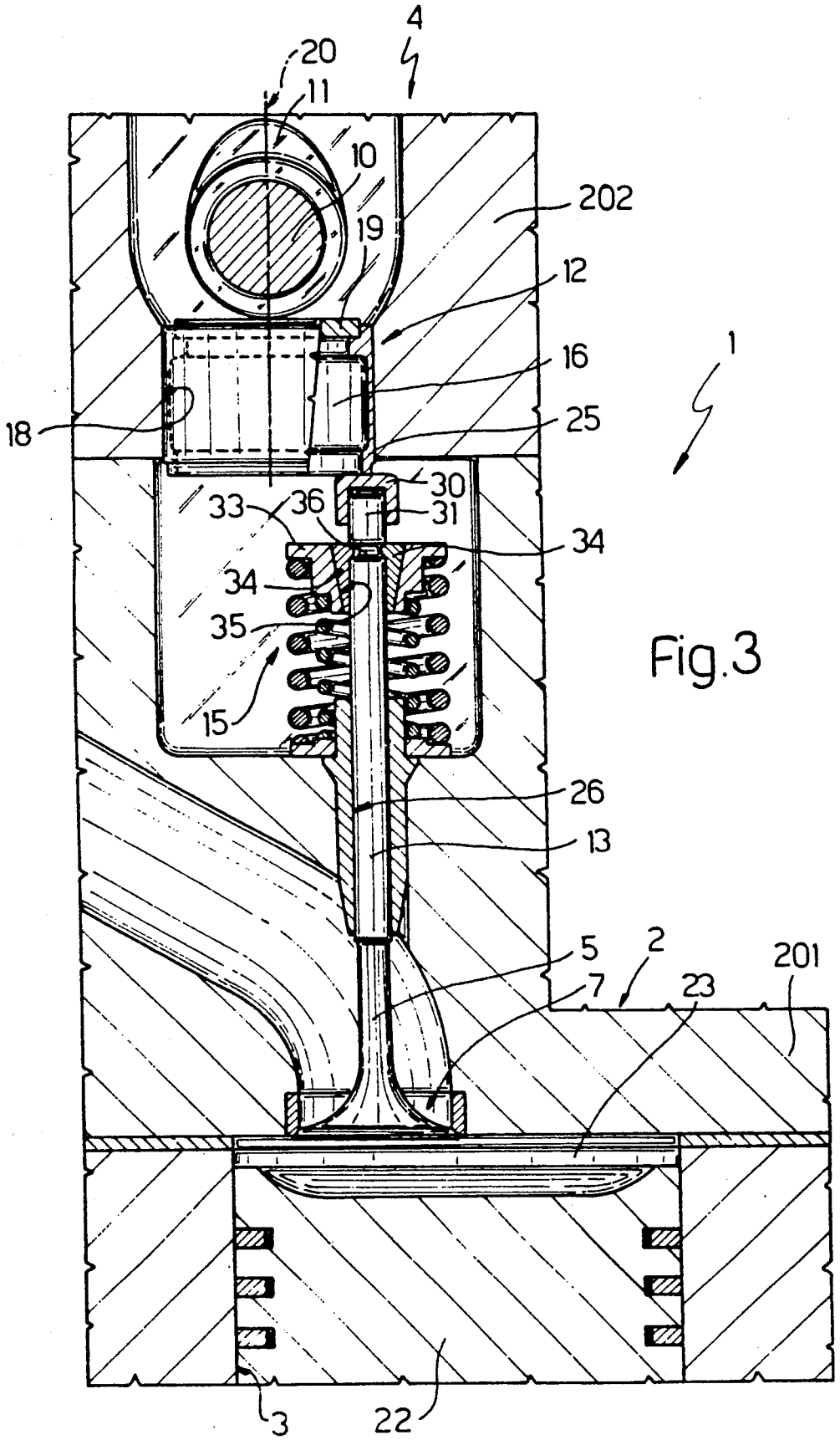
FIGS. 3 and 4 are two views in elevation of the feed system according to the invention in a transverse cross-sectional plane at 90° with respect to the plane in FIG. 2 relating to an intermediate valve and a lateral valve in the said system respectively.

With reference to FIGS. 1 to 4, 1 shows as a whole an internal combustion engine of a known type, which is illustrated for the sake of simplicity merely by means of an upper portion comprising a cylinder head 2 and a single cylinder 3 therebelow together defining the head 2 of a combustion chamber of motor 1, the other combustion chambers defined by other cylinders 3 of engine 1 not being illustrated for the sake of simplicity. Engine 1 is provided with a timing system, indicated as a whole by 4, comprising for each cylinder 3, in accordance with the non-restrictive embodiment illustrated, five valves, in this embodiment three adjacent feed valves, two lateral valves 5 and an intermediate valve 6 respectively, and two adjacent exhaust valves, which are known and are not illustrated, for the sake of simplicity; all of the abovementioned valves are of the poppet valve type and are capable of controlling the opening/closing of corresponding inlet 7 and exhaust 8 ports in cylinder 3. These are arranged as a crown in cylinder head 2, opposite the top of a combustion chamber 23 defined by this and corresponding cylinder 3, and are arranged substantially in accordance with the apices of a pentagon.

Timing system 4 also includes a corresponding camshaft 10 for simultaneous control of all the valves 5, 6 of all the cylinders 3 in engine 1 and a similar camshaft, which is known and not illustrated, for the sake of simplicity, which controls the valves for the exhaust ports 8 of all the cylinders 3 of engine 1 in a known way. Shaft 10 includes corresponding control cams 11 of a predetermined profile which act together with corresponding tappets 12 to control the linear movement of corresponding stems 13 of valves 5, 6 against the force of corresponding opposing elastic means 15 thus controlling the axial displacement of valves 5, 6 and consequently the opening/closing of corresponding ports 7. In accordance with the non-restrictive embodiment illustrated, timing system 4 according to the invention provides an overhead camshaft arrangement, or an arrangement in which the cams 11 of camshaft 10 act directly in concert with tappets 12, and these may be either of the mechanical type without play adjustment, as in the non-restrictive embodiment illustrated, or of any known hydraulic type with automatic take-up of play. In any event these each include a corresponding cylindrical cup 16 which is housed so as to slide axially within a corresponding guide seat 18 made in head 2, and, if appropriate, a small plate 19 supported above and outside cup 16 in such a way as to lie between the latter and corresponding cam 11. Cylindrical cup 16 forms the outer body of each tappet 12 and a longitudinal axis of symmetry 20 thereof (FIGS. 3, 4, 5) as a consequence defines the axis of the corresponding tappet 12.

Figure 4:
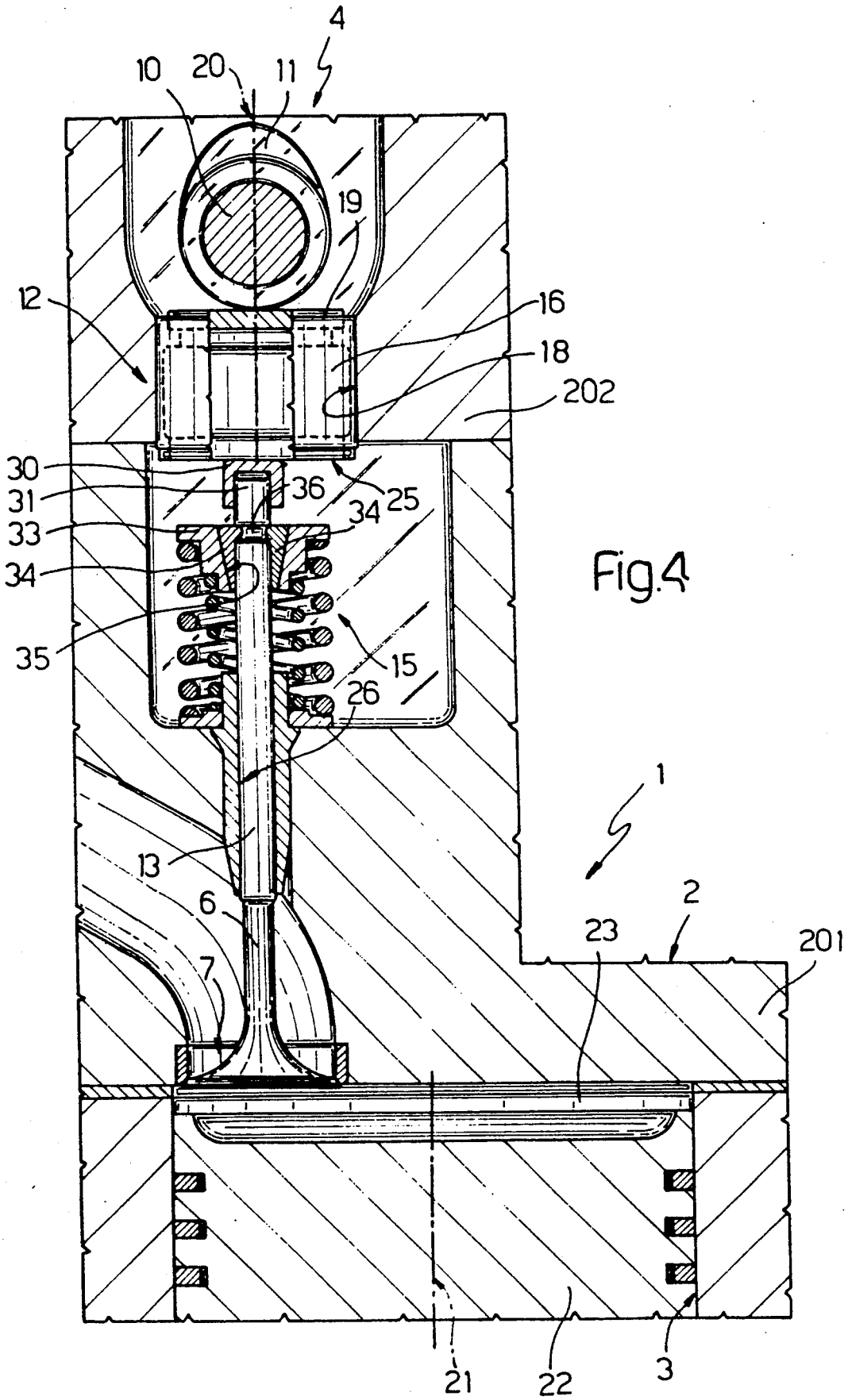

Valve stems 13 of valves 5, 6 are entirely parallel to each other and are all parallel to the axis 20 of tappets 12, and the axis of cylinder 3, indicated by 21 in FIG. 4, so that by suitable shaping of corresponding pistons 22 which are slidably mounted in a known way in cylinders 3 it is possible to construct combustion chambers 23 of the "Heron" type which, as is known, are particularly advantageous from the thermodynamic point of view. In accordance with the invention this type of combustion chamber can be used while valves 5, 6 are controlled by a single camshaft 10, while at the same time ensuring a large inlet cross-section as a result of the fact that stems 13 are arranged radially eccentrically with respect to axes 20 by an amount such that stems 13 act together with tappets 12 in a highly peripheral position, substantially close to the corresponding side walls 25 of cups 16. Also tappets 12 are fewer in number in comparison with valve stems 13 to be controlled and the relative position between the latter and tappets 12 is such that at least one of tappets 12 which control the valves for each cylinder 3 acts together simultaneously with both the stems 13 of a pair of identical adjacent valves.

In the non-restrictive embodiment illustrated the three valves 5, 6 are controlled by only two tappets 12 which act together on the one side with two corresponding cams 11 of camshaft 10 which has the same axis therewith, and, on the opposite side, substantially at side walls 25, with corresponding stems 13 which are slidably guided in corresponding seats 26 in cylinder head 2 which are constructed with considerable radial eccentricity with respect to axis 20 such that the valve stem of intermediate valve 6 acts together simultaneously with both tappets 12, being located substantially in the empty space between them, or alongside and below the so-called "crown" of head 2 between seats 18 lying in a central plane of cylinder 3 perpendicular to cam axis 10 whose line is shown by A in FIG. 1, and with respect to which stem 13 of valve 6 lies in a position corresponding substantially to that of camshaft 10 as a result of which in the cross-sectional plane shown in FIG. 4, which is plane A, stem 13 of valve 6 is "coaxial" with tappets 12, so that like axis 20 it lies in the plane passing through the axis of shaft 10 and parallel to axis 21.

Vice versa valve stems 13 of the two lateral valves 5 each act in concert with a corresponding different tappet 12, in a position which for each of these is displaced in a radial direction from corresponding axis 20 of the tappets either towards port 8 or towards the side wall of cylinder 3 so that the stems of valves 5 are placed in a position of mirror-image symmetry with respect to plane A.

In particular stems 13 act together with tappets 12 exactly at the corresponding lower peripheral edges of cups 16 which run in guides or seats 18 in the cylinder head. In order to compensate for any error in positioning between the cups of the two tappets 12 in relation to the stem of valve 6 which these jointly control, corresponding members which take up play, indicated by 30, are preferably placed between stems 13 and cups 16. In practice these members taking up play consist of a corresponding thimble of calibrated thickness mounted over a corresponding end 31 for each of the said stems 13.

Clearly, with the arrangement described cylinder head 2 must be of the so-called "castellated" type, i.e. constructed of two superimposed pieces 201 and 202 in which seats or guides 26 are made correspondingly for stems 13 and 18 for tappets 12, and the elastic opposing means 15 consist of corresponding helicoidal springs mounted around rods 13 and wholly housed outside cups 16 of tappets 12. In particular these springs 15 act against corresponding shoulder plates 33 which are integrally mounted on each corresponding rod 13 in a position immediately below tappet 12 with which the stem acts, by means of a pair of cotters 34 (FIGS. 3, 4) which act together with an internal tapering surface 35 in corresponding plate 33 and with a corresponding groove 36 in corresponding stem 13.

When in use cams 11 control the linear movement of tappets 12 which in turn control the linear movement of stems 13, against the said springs thereof. Lateral valves 5 are thus each controlled by one of the two tappets 12, while central valve 6 is simultaneously controlled by both tappets 12. As a consequence valves 5, 6 are all controlled in the same way, cams 11 having the same profile, but may be placed at a distance from one another which is greater than the distance between the two tappets 12, thus making it possible to construct large well-spaced ports 7.

From what has been described the advantages associated with the invention are clear. With only the minor problem of greater height in cylinder head 2 it is possible to construct an engine with "Heron" combustion chambers thus at the same time ensuring a high cross-section for the passage of fluids and simple and immediate service and control of the valves. Finally it is clear that variants and modifications may be made to what has been described without thereby going beyond the scope of the invention. For example what has been described also applies to engines with six valves per cylinder (or with three ports 7 and three ports 8), doubling the arrangement adopted for the valves of ports 7 and for ports 8. Likewise the system described can also be used to control four adjacent identical valves by means of only two tappets, each acting on a pair of adjacent valves, as each tappet 12 controls a valve 5 and valve 6.

I claim:

1. A timing system, in particular for an internal combustion engine, comprising;

a) a number of identical service valves carrying out the same function in serving a respective, same cylinder, b) elastic contrast means for said service valves, c) a single camshaft controlling all of said service valves carrying out the same function by means of its respective cams; and, d) a number of respective tappets slidably guided in first seats provided in a cylinder head and interposed between said cams and respective stems of said service valves, said respective stems guided in second seats provided in said cylinder head and parallel to said first seats; wherein the number of said service valves is greater than the number of said respective tappets, each of said tappets directly cooperates with a corresponding one of said cams of said camshaft, and wherein said stems of said service valves carrying out the same function are positioned parallel to each other and to the axes of said tappets and radially eccentric therewith by an amount such that said stems are disposed peripherally with respect to said tappets and adjacent to respective side walls of said tappets; the timing system being characterized in that said tappets act onto said stems of said service valves independently of each other and against said respective said side walls of said tappets, each of said tappets acting in direct control of any two adjacent stems of said respective stems corresponding to said service valves having the same function and at least one of said valves having the same function has two adjacent tappets of said tappets acting simultaneously thereon and in a manner independent of each other and onto said stem of said at least one of said valve.

2. A timing system as recited in claim 1 and wherein;

a) said identical service valves are at least three in number and comprise an intermediate valve and two opposite lateral valves controlling the inflow or outflow of a fluid to and from said cylinder wherein all of said three identical service valves are controlled by only two of said tappets, each of said only two of said tappets directly cooperate at first ends thereof with a separate cam of said camshaft and at opposite second ends thereof adjacent said respective side walls with said stems of said three identical service valves and in a manner such that each of said only two of said tappets simultaneously cooperating at said opposite second ends with a separate one of said lateral valve stems and both of said only two of said tappets simultaneously and independently cooperating at said opposite second ends with said stem of said intermediate valve so that said intermediate valve is simultaneously controlled by each of said only two of said tappets while said valve stems of said two opposite lateral valves are each controlled by a separate one of said only two of said tappets, said only two of said tappets acting on said stems of said two opposite lateral valves do so in positions which are mirror-image symmetry with respect to a central plane of said cylinder passing through the axis of said intermediate valve.

3. A timing system according to claim 1, characterised in that said valve stems act together with corresponding peripheral lower edges of corresponding cylindrical cups of said tappets, said cups acting in contact with said first seats of the cylinder head and on the other side of said stems with said cams of the camshaft; corresponding members to compensate for play being placed between the valve stems and said cups.

4. A timing system according to claim 1, characterised in that said members compensating for play consist for each said valve stem of a corresponding thimble of calibrated thickness mounted upon a corresponding end of the valve stem.

5. A timing system for an internal combustion engine according to claim 1, characterised in that said valve stems are placed in parallel with a central axis of the cylinder, the latter, together with said cylinder head and a piston slidably mounted within said cylinder, forming a combustion chamber of the "Heron" type.

6. A timing system according to claim 1, characterised in that said elastic means include corresponding helicoidial springs mounted around said valve stems and housed completely outside said tappets, said springs acting on corresponding shoulder plates each integrally mounted on a corresponding valve stem in a position immediately below said tappet with which said tappet acts by means of a pair of cotters acting together with an internal tapering surface of said plate and with a corresponding groove in said valve stem.

* * * * *